US005695083A

United States Patent [19]

Obadia

[11] Patent Number: 5,695,083

[45] Date of Patent: Dec. 9, 1997

[54] LEAKTIGHT SCREW CAP WITH DISK HAVING A GAS-BARRIER EFFECT

[75] Inventor: Jacques Obadia, Paris, France

[73] Assignee: Rical, S.A., Longvic, France

[21] Appl. No.: 797,999

[22] Filed: Feb. 12, 1997

Related U.S. Application Data

[63] Continuation of Ser. No. 146,030, filed as PCT/FR92/00443 published as WO92/20589 Nov. 26, 1992, abandoned.

[30] Foreign Application Priority Data

May 21, 1991 [FR] France ..... 91 06113

[51] Int. Cl.[6] ..... B65D 41/04

[52] U.S. Cl. ..... 215/329; 215/343; 215/320

[58] Field of Search ..... 220/255, 256; 215/216–221, 341, 343, 349, 347, 351, 350, 320, 361, 230, 254, 256, 258, 272, 329

[56] References Cited

U.S. PATENT DOCUMENTS

| | | | |
|---|---|---|---|
| 1,276,768 | 8/1918 | Hoyle et al. | 220/256 |
| 3,325,035 | 6/1967 | Strickman | 215/348 |
| 3,330,720 | 7/1967 | Stevens et al. | 215/347 X |
| 3,428,201 | 2/1969 | Boys | 215/220 |
| 3,565,274 | 2/1971 | Davidson | 215/341 X |
| 3,866,845 | 2/1975 | Keeler et al. | 215/341 X |
| 3,963,845 | 6/1976 | Dukess | 215/347 X |
| 3,973,688 | 8/1976 | Kvam | 215/272 |
| 4,279,353 | 7/1981 | Honma | 215/272 X |
| 4,347,939 | 9/1982 | Upton | 215/341 X |
| 4,460,428 | 7/1984 | Chang | 215/270 |
| 4,605,235 | 8/1986 | Ryder | 215/217 X |
| 4,723,678 | 2/1988 | Kollen et al. | 215/347 |
| 4,756,437 | 7/1988 | Mossati . | |
| 4,771,905 | 9/1988 | Perne et al. | 215/329 X |
| 4,785,952 | 11/1988 | Obadia | 215/329 X |
| 4,801,030 | 1/1989 | Barriac | 215/258 X |
| 5,115,928 | 5/1992 | Drummond, Jr. | 215/221 X |
| 5,115,930 | 5/1992 | Lohrman et al. | 215/230 X |
| 5,299,701 | 4/1994 | Barker et al. | 215/230 |

FOREIGN PATENT DOCUMENTS

| | | |
|---|---|---|
| 112103 | 6/1984 | European Pat. Off. . |
| 117722 | 9/1984 | European Pat. Off. . |
| 0239238 | 9/1987 | European Pat. Off. . |
| 280168 | 8/1988 | European Pat. Off. . |
| 0306820 | 3/1989 | European Pat. Off. . |
| 623522 | 11/1994 | European Pat. Off. . |
| 1 101 829 | 10/1955 | France . |
| 1 173 217 | 2/1959 | France . |
| 1 191 865 | 10/1959 | France . |
| 1 197 200 | 11/1959 | France . |
| 2 439 721 | 5/1980 | France . |
| 2108940 | 5/1983 | United Kingdom . |

*Primary Examiner*—Allan N. Shoap
*Assistant Examiner*—Robin A. Hylton
*Attorney, Agent, or Firm*—Beveridge, Degrandi, Weilacher & Young, LLP

[57] ABSTRACT

Leaktight screw cap composed of two cup-shaped shells rendered integral by fitting one into the other, the lowest shell being made from a flexible plastic having a female thread and a sealing device and the outer shell being made from a hard plastic. A disk made from a material having a gas-barrier effect is inserted between the bottoms of the outer shell of the inner shell. This screw cap is especially applicable to beverages and other products that are sensitive to gas exchanges with the outside.

25 Claims, 3 Drawing Sheets

LEAKTIGHT SCREW CAP WITH DISK HAVING A GAS-BARRIER EFFECT

This application is a continuation of application Ser. No. 08/146,030, filed as PCT/FR92/00443 published as WO92/20589 Nov. 26, 1992, now abandoned which application is entirely incorporated herein by reference.

The present invention relates to a leaktight screw cap comprising a cup-shaped body comprising, on its lateral wall, a female thread interacting with a male thread of the neck of the container and on its bottom sealing means interacting with the neck of the container.

BACKGROUND OF THE INVENTION

Known leaktight caps of this type are generally one-part caps made from plastic. The plastics used most are polyethylene, that is to say a relatively flexible material and the more rigid polypropylene. In the case of beverages, polyethylene is generally used for non-carbonated or slightly carbonated beverages, whereas polypropylene is used for highly carbonated beverages on account of its better gas impermeability.

However, there exist numerous cases of packaging where the gas impermeability provided by caps made from polypropylene is still insufficient. This is the case during the packaging of products sensitive to the action of oxidation from oxygen in the air (fats, sauces, fruit juices), responsible for an organoleptic alteration which may rapidly render the product unsuitable for eating. This also applies to the preservation of the $CO_2$ content of highly carbonated beverages. Another problem consists in the losses of aromas and of volatile substances from spices and essential oils. Finally, gas-impermeability defects lead to risks of picking up undesirable odours by a product such as the water in plastic bottles during storage or transport in a confined space.

In order to attempt to solve these problems, a leaktight cap has already been proposed, for example according to European Patent Application No 0,280,068, produced from an oxygen-permeable thermoplastic material, for example polypropylene, the bottom of which is internally covered with an oxygen-impermeable complex sheet (paper, chlorinated rubber, PVC), a plastisol seal being cast onto the said complex sheet. However, this cap is not always satisfactory, especially in the case of beverages, the complex sheet being in contact with the contents of the container which is made leaktight by the cap.

Moreover, it has already been proposed, for example by French Patent No. 1,197,200, to produce a leaktight screw cap from two cup-shaped shells fitted one into the other, the inner shell consisting of a flexible plastic and comprising, on its lateral wall, a female thread capable of interacting with a male thread of the neck of the container and, on its bottom sealing means which are capable of interacting with the neck of the container and the outer shell consisting of a hard plastic.

Both shells may therefore be produced in an optimal material taking into account the function which they have to fulfil in the cap. Thus, in order to obtain good sealing with respect to liquids, the use of polyethylene, that is to say a flexible and low-hardness material, is perfectly suitable for the inner shell which is in contact with the packaged product and with the neck of the container and which, on account of its flexibility, adapts well to defects which the container may also have. By contrast, the outer shell may be produced from a hard and rigid material exhibiting, moreover, good properties in terms of resistance to mechanical stresses which could jeopardise the sealing if they were exerted on a single-part cap made from a flexible plastic. However, the lower gas-impermeability of these caps formed from two shells is often not satisfactory.

SUMMARY OF THE INVENTION

The present invention is directed towards a leaktight cap of the type having two fitted shells which, whilst being of simple manufacture and of low cost, ensures both good sealing with respect to liquids and good gas-impermeability and can be used without problems for products of the greatest diversity.

In the leaktight cap in accordance with the invention, the gas impermeability is ensured solely or principally by a disk having a gas-barrier effect which is inserted between the bottom of the outer shell and the bottom of the inner shell.

Thus, the disk is imprisoned between the inner shell and the outer shell. The disk being so positioned, is isolated and protected both in relation to the product contained in the container, by virtue of the inner shell, and in relation to the outside, by virtue of the outer shell.

This disk, instead of simply being placed between the bottoms of the two shells, can also be fixed internally to the bottom of the outer shell, for example by adhesive bonding or by welding, preferably by ultrasound. Likewise, this disk could be fixed by adhesive bonding or by welding, preferably by ultrasound, externally to the bottom of the inner shell.

Another possibility consists in arranging for the said disk to be overmoulded using the material of the outer shell, or of the inner shell, which eliminates any subsequent fixing.

The disk in question may advantageously be formed from a complex sheet, for example a sheet of metallised plastic. When this complex sheet has to be connected by moulding or by welding to the outer shell and/or to the inner shell, it should comprise, on the side of the shell to which it is to be connected, a material lending itself to a connection by melting or by welding with the material of the shell in question.

BRIEF DESCRIPTION OF THE INVENTION

Referring to the attached drawings, there will be described hereinbelow in more detail several illustrative non-limiting embodiments of a screw cap in accordance with the invention; in the drawings.

Figure 1:
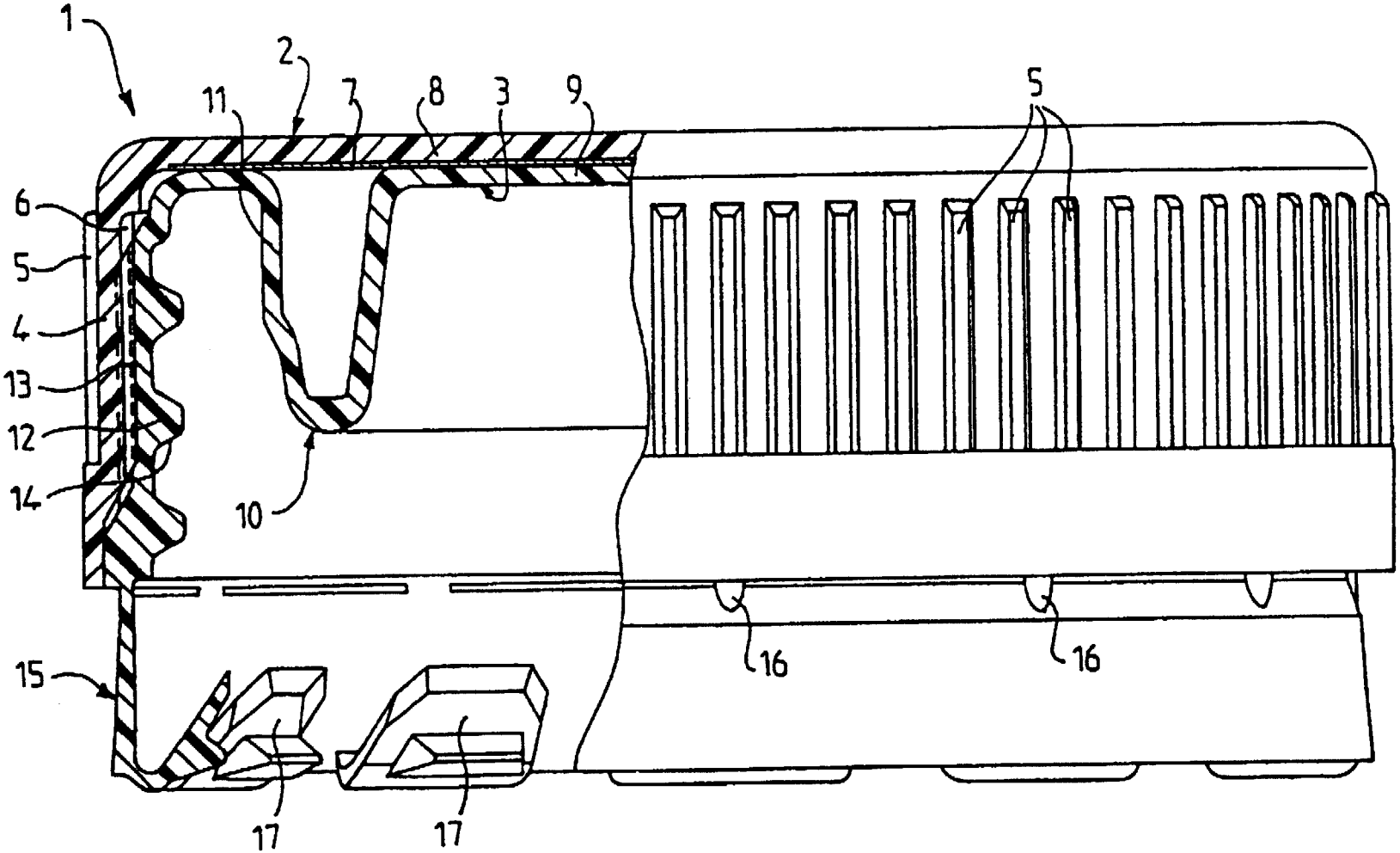
FIG. 1 is a side view, in partial cross-section, of a first embodiment of a cap in accordance with the invention.

The leaktight screw cap 1, such as illustrated by FIG. 1, is composed of a cup-shaped outer shell 2 and of an inner shell 3 which is also generally cup-shaped, the two shells 2 and 3 being fitted one into the other. Cup-shaped outer shell 2 includes end wall portion or bottom 8 off from which extends lateral wall 4. Cup-shaped inner shell 3 includes end wall portion or bottom 9 off from which extends lateral wall 12.

The outer shell 2 is produced by injection moulding from a relatively hard plastic such as polypropylene. It comprises, on its lateral wall 4, an outer knurling 5 and an inner knurling 6 consisting of grooves and ribs which are parallel to the axis of the cap.

A disk 7 constituted by a complex of plastic and metal, preferably a sheet of metallised polypropylene, internally covers the bottom 8 of the outer shell 2. The disk 7 may preferably be overmoulded using the plastic of the outer shell 2. The inner shell 3 produced by moulding, preferably by injection moulding, from a flexible plastic such as polyethylene, comprises, on its bottom 9, an annular inner depression 10, known per se, the outer flank 11 of which is intended to interact with the inner face of the neck of a container to be made leaktight. The lateral wall 12 of the inner shell 3 externally comprises axial knurling 13 which interacts with the inner axial knurling 6 of the outer shell 2, during the fitting of the two shells 2, 3 one into the other, and internally comprises a female thread 14 intended to interact with the male thread of the neck, not shown, of the container to be made leaktight.

The inner diameter of the outer shell 2 and the outer diameter of the inner shell, on the lower cylindrical portions of the lateral walls 4, 12 of these shells, are chosen so that the two shells 2,3 can be rendered integral axially, one with the other, by simple force fitting. The two shells 2, 3 moreover are integral rotationally, one with the other, by virtue of the interpenetration of their knurlings 6, 13.

At its lower end, the lateral wall 12 of the inner shell 3 comprises a tamper-proof ring 15 of type known per se connected via frangible bridges 16 to the shell 3. In the example shown, the ring 15 comprises a circumferential row of flexible tabs 17 intended to interact, by being turned back towards the bottom of the cap 1, with a flange, not shown, provided on the end of the container, beneath the thread, so that after installing the entire cap 1 on the neck of the container, the first unscrewing of the cap 1 causes the bridges 16 to break, and therefore a detachment, at least in part, of the ring 15, which indicates in a clearly visible and irreversible manner that the container has undergone a first opening or attempted opening.

Figure 2:
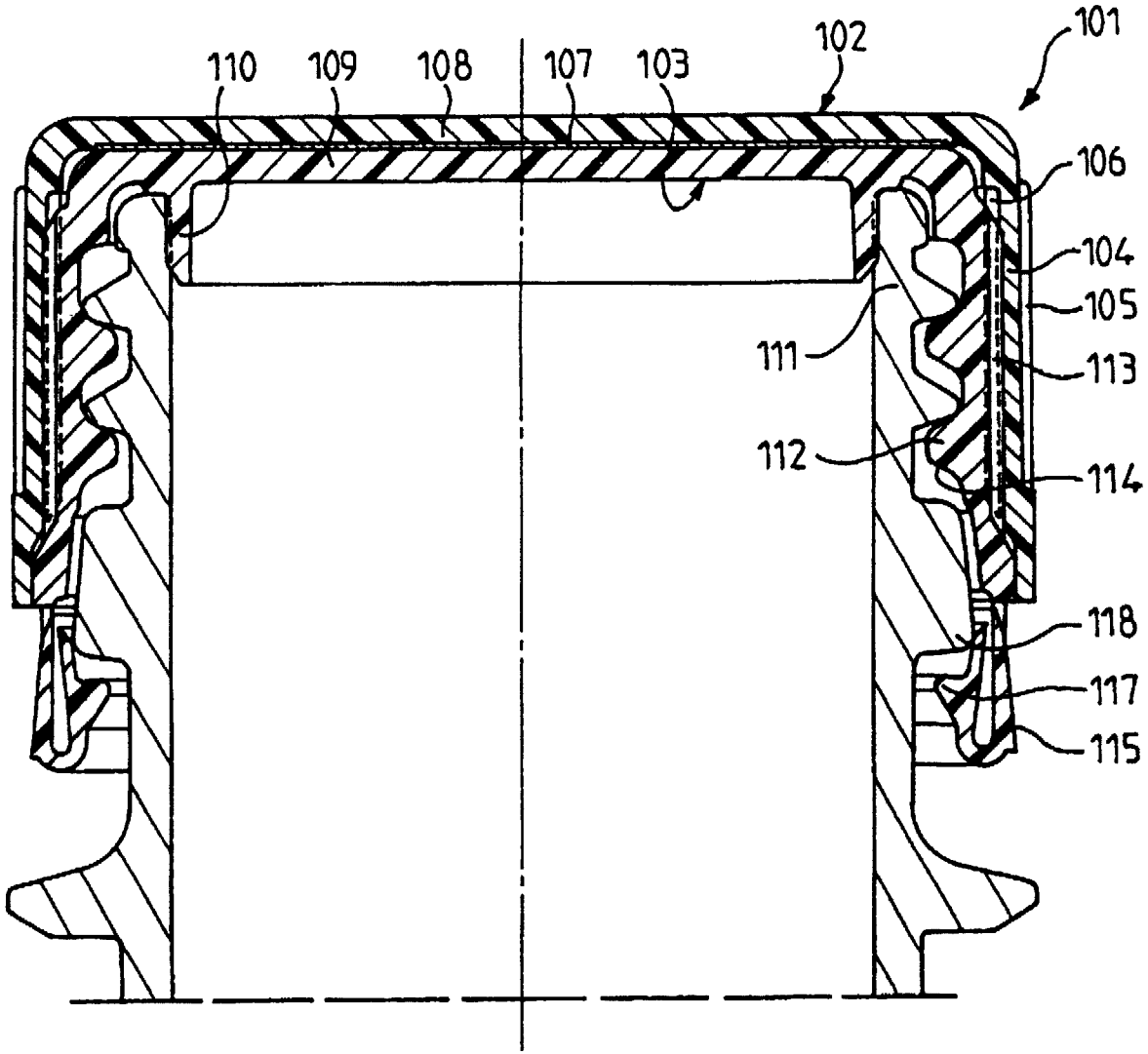
FIG. 2 is an axial cross-section of a second embodiment of a cap in accordance with the invention, in a leaktight position on a bottle neck.

The cap 101 according to the embodiment illustrated by FIG. 2 is also composed of an outer shell 102 and of an inner shell 103.

The outer shell 102 comprises, in a manner similar to the outer shell 2 of FIG. 1, a lateral wall 104 with an outer knurling 105 and an inner knurling 106, together with a disk 107 that provides a gas-barrier effect on the inner face of the outer shells bottom 108.

The inner shell 103 differs from the inner shell 3 of the cap 1 according to FIG. 1 solely by the presence of a sealing skirt 110 projecting over the bottom 109 of the shell 103 in order to interact with the inner face of the neck 111 of a container. Apart from that, encountered again on the inner shell 103, a lateral wall 112 equipped with an outer knurling 113 and a female thread 114 interacting with the male thread 119 is provided on the neck of the container. At its lower end, the lateral wall 112 of the inner shell 103 carries a tamper-proof ring 115 which here is shown in the position in which its tabs 117 interact with the flange 118 of the neck of the container to be made leaktight.

In the two embodiments shown, in FIGS. 1 and 2, the disk 7, 107 having a barrier effect inserted between the bottoms 8, 9 and 108, 109 of the two shells 102 and 103 may be fixed, for example by welding using ultrasound, to one and/or to the other of the two shells 2, 3 and 102, 103. It is also possible to overmould the disk 7, 107 using the material of the outer shell 2, 102, during the injection moulding of the latter. In order to permit a connection to be made by melting of the disk 7, 107 with the outer shell 2, 102, it is necessary to provide, on this disk 7, 107 whose barrier effect may preferably be obtained by a metallic layer, a layer of a plastic lending itself to a connection by melting with material of the said shell. The same also applies when the disk 7, 107 is to be connected to the inner shell 3, 103.

Figure 3:
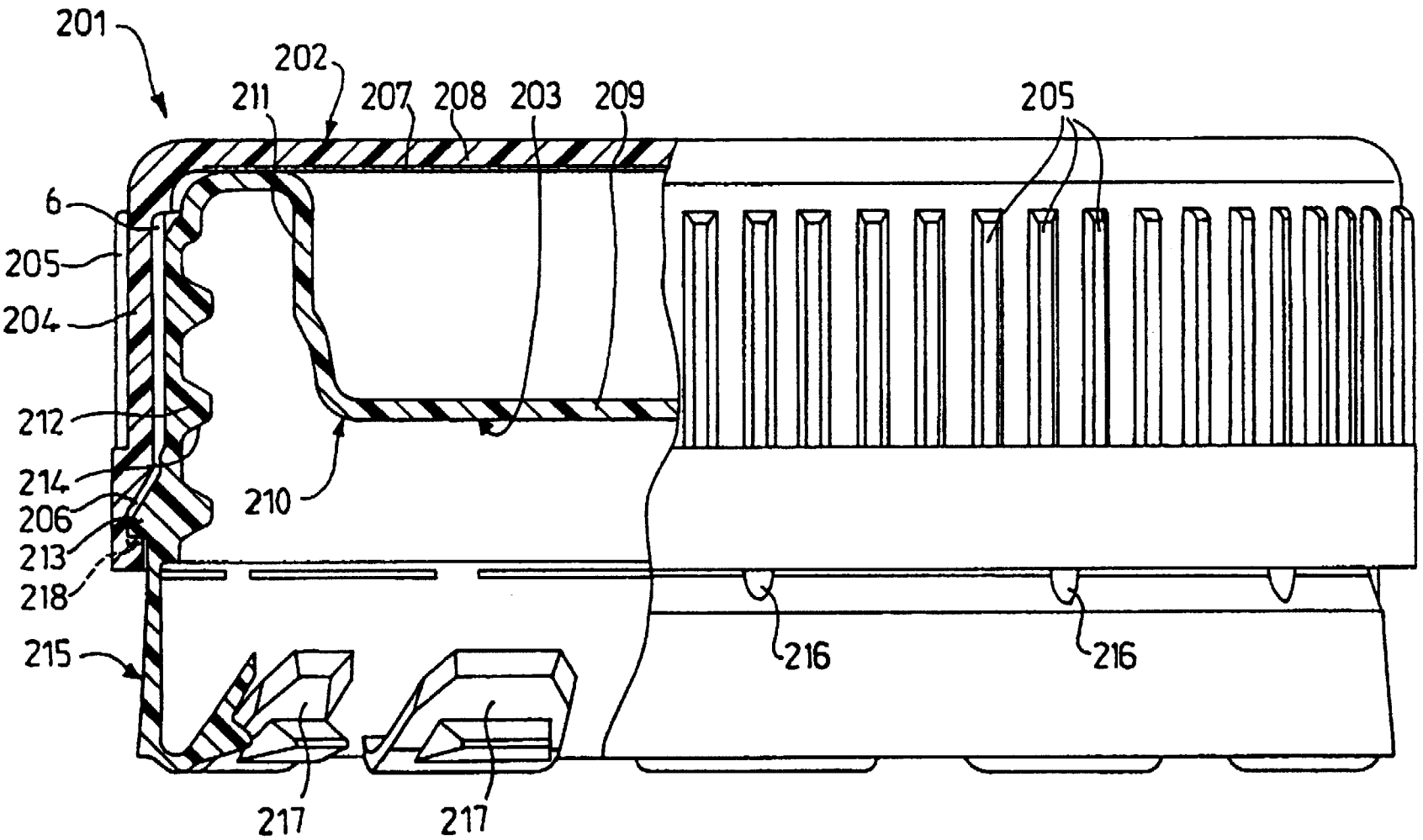
FIG. 3 is an axial cross-section of a third embodiment.

The cap 201 of FIG. 3 comprises an outer shell 202 and an inner shell 203 which, fitted one into the other, are integral axially, one with the other, by a circumferential groove 206 internally provided in the lateral wall 204 of the outer shell and by a flange 213 externally provided on the lateral wall 212 of the inner shell 203. The flange 213 is snap-fastened into the groove 206 when finally fitting the two shells one into the other. The two shells 202 and 203 are rendered integral one with the other in the circumferential direction by teeth 218 provided on the groove 206 and on the flange 213. The outer shell is also externally provided with knurling 205.

In addition, in the embodiment of FIG. 3, the inner shell 203 comprises a femal thread 214 on its lateral wall 212 and from whcih extends tamper proof ring 215. The sealing means 210 of the inner shell 203 comprises a skirt 211 to the lower end of which is joined bottom 209, having a flat-plate shape. The disk 207 linked to the inner face of the bottom 208 of the outer shell 202 thus is positioned some distance away from the bottom 209 of the inner shell.

It goes without saying that the embodiments shown and described have been given only by way of illustrative and non-limiting examples and that numerous modifications and alternative forms are possible within the scope of the invention.

Thus, sealing means other than the annular depression 10 according to FIG. 1, the skirt 110 according to FIG. 2 or the plate skirt 210 according to FIG. 3 may be provided on the inner shell 3, 103, 203 in order to ensure sealing with the neck of the container to be made leaktight.

It should, moreover, be pointed out that the manufacture of the outer shell 2, 102, 202 is extremely simple and may be carried out at a very high rate, on account of the absence of inner thread. Now, it is precisely on account of the female thread that the demoulding of the one-part caps made from relatively rigid plastic leads to a great reduction in the rate of manufacture.

In addition, in the cap in accordance with the invention, the two shells may be produced from materials of different colours, which not only gives a pleasing appearance to the cap (tamper-proof ring of a colour different from the visible remaining portion, namely the outer shell), but renders even more apparent any attempt at opening the container.

Finally, although the disk 7, 107, 207 is defined as being made from a material having a gas-barrier effect, this barrier effect is also applicable to vapours, aromas, odours and other volatile substances.

I claim:

1. A leaktight and gas-impervious screw cap for a container, comprising:

an inner cup shaped shell and an outer cup shaped shell rendered integral by fitting said inner cup shaped shell into the outer cup shaped shell, and each shell being provided with an end wall portion and a side wall portion, said inner shell being formed of a flexible plastic, and said end wall portion of said inner shell including a sealing member positioned for interaction with an inner surface of a neck of the container, and the side wall portion of said inner shell including a female thread positioned on an interior surface of the side wall portion of said inner shell for interaction with a male thread of the container neck, and said outer shell being formed of a hard plastic that is less flexible than the flexible plastic of said inner shell wherein said integral relationship is such that said shells are prevented from both axially and rotationally shifting with respect to each other; and a disk made from a material having a gas-barrier effect with respect to gas permeability, and said disk being positioned between the end wall portion of said outer shell and the end wall portion of said inner shell such that said cap is gas impervious.

2. Cap according to claim 1, wherein said two shells (2, 3; 102, 103; 202, 203) are constituted by materials of different colours and in that a tamper-proof ring (15, 115, 215) is produced as a single part with the inner shell (3, 103, 203) in such a manner that said ring extends beyond the outer shell (2, 102, 202) when the two shells are fitted one into the other.

3. Cap according to claim 1, wherein said two shells (202,203) are rendered integral axially by a circumferential groove (206) and by an annular flange (213) interacting by snap fastening when finally fitting the two shells one into the other.

4. Cap according to claim 3, wherein said two shells (202, 203) are rendered integral in a circumferential direction by teeth (218) provided on the said groove (206) and on the said flange (213).

5. Cap according to claim 1 wherein said disk (7, 107, 207) is formed from a complex sheet comprising, on an outer-shell side, a material lending itself to a connection by thermal bonding with a material of the outer shell.

6. Cap according to claim 1, wherein said disk (7, 107, 207) is formed from a complex sheet comprising, on an inner-shell (3, 103, 203) side, a material lending itself to a connection by thermal bonding with material of the inner shell.

7. Cap according to claim 1, wherein said two shells (2, 3; 102, 103; 202, 203) are constituted by materials of different colors.

8. Cap according to claim 1, wherein said two shells (202, 203) are rendered integral axially by a circumferential groove (206) and by an annular flange (213) interacting by snap-fastening when finally fitting the two shells one into the other, said annular flange being positioned on an exterior surface of the side wall of said inner cup at an axial location which is essentially commensurate with a section of said female thread furthest removed from said end wall.

9. A screw cap as recited in claim 1 wherein said outer shell is a one piece molded member and said inner shell is a one piece molded member.

10. A screw cap as recited in claim 9 wherein said inner shell is formed of polyethylene and said outer shell is formed of polypropylene.

11. A screw cap as recited in claim 1 wherein said inner shell is formed of polyethylene and said outer shell is formed of polypropylene and said disk is constituted by a complex of plastic and metal.

12. A screw cap as recited in claim 1 wherein said disk includes a metal layer.

13. A screw cap as recited in claim 1 wherein said inner and outer shells include engaging knurled surfaces which render said inner and outer shells integral rotationally.

14. A screw cap as recited in claim 1 wherein said disk is fixed to the end wall portion of at least one of said inner and outer shells.

15. A screw cap as recited in claim 14 wherein said disk is fixed by a weld to said at least one of said inner and outer shells.

16. A screw cap as recited in claim 1 wherein said disk is overmoulded with respect to one of said shells by using the plastic of said one of said shells.

17. A screw cap according to claim 8 wherein said two shells are rendered rotationally integral by engaging teeth provided on said groove and said flange.

18. A screw cap according to claim 1 wherein said disk includes a layer which includes a metal material supported by a plastic layer with the plastic layer being bonded to one of said shells.

19. A screw cap according to claim 18 wherein said outer shell is a one piece molded member formed of polypropylene and said inner shell is formed of polyethylene.

20. A screw cap according to claim 1 wherein said outer shell is a one-piece molded member formed of polypropylene, and said inner shell is formed of a more flexible material.

21. A screw cap according to claim 1 wherein the sidewall of said outer shell has a knurled interior surface and the side wall of said inner shell has a knurled exterior surface which is arranged for fitting with the knurled interior surface of said outer shell to both circumferentially and axially fix said shells in position.

22. A screw cap according to claim 17 wherein said sealing member includes an end wall which features an annular inner depression (10) radially inwardly spaced from the side wall of said inner shell.

23. A screw cap according to claim 1 wherein said sealing member, which is formed in the end wall of said inner shell, includes an annular ring section extending off and radially inward of said side wall, a skirt section (211) extending axially off from said annular ring section so as to be juxtaposed to the side wall of said inner shell, and a circular bottom section (209) extending off from an end of said skirt section so as to be at a different axial level than said annular ring section.

24. A screw cap according to claim 1 wherein said sealing member, which is formed in the end walls of said inner shell, includes a sealing skirt extending axially in a common direction at said side wall of said inner shell and radially inward of the side wall of said inner shell.

25. A screw cap according to claim 1 wherein said disk is fixed to at least one of said shells so as to preclude axial shifting thereof with respect to said at least one of said shells.

* * * * *